US006000752A

United States Patent [19]

Shyr

[11] Patent Number: 6,000,752

[45] Date of Patent: Dec. 14, 1999

[54] FOLDING CHAIR WITH COOLER

[76] Inventor: Michael H. Shyr, 2250 Nadula Dr., Hacienda Heights, Calif. 91745

[21] Appl. No.: 09/163,130

[22] Filed: Sep. 29, 1998

[51] Int. Cl.[6] ..... A47C 7/62

[52] U.S. Cl. ..... 297/188.08; 297/188.01; 297/188.13; 297/16.1; 297/16.2; 297/17; 297/129; 297/217.1

[58] Field of Search ..... 297/188.08, 188.13, 297/188.01, 16.1, 16.2, 17, 217.1, 188.12, 129

[56] References Cited

U.S. PATENT DOCUMENTS

| | | | |
|---|---|---|---|
| 192,380 | 6/1877 | Lovell | 297/188.1 |
| D. 200,309 | 2/1965 | Sokolis | 297/188.08 X |
| 2,375,819 | 5/1945 | Reid | 297/188.13 X |
| 2,909,215 | 10/1959 | Mitchell | 297/188.08 X |
| 3,014,760 | 12/1961 | Gard | 297/188.08 |
| 3,077,327 | 2/1963 | Batie et al. | 297/188.01 X |
| 3,122,397 | 2/1964 | Mintz | 297/188.13 |
| 3,128,137 | 4/1964 | Dokter | 297/188.08 X |
| 3,298,737 | 1/1967 | Rosenfeld et al. | 297/188.08 |
| 4,103,965 | 8/1978 | Engmann | 297/188.12 |
| 4,387,924 | 6/1983 | Fernandez | 297/188.01 |
| 4,650,245 | 3/1987 | Nazar | 297/188.13 |
| 4,799,731 | 1/1989 | Brown | 297/188.13 X |
| 5,156,310 | 10/1992 | Biedenharn, Jr. | 297/188.13 X |
| 5,318,342 | 6/1994 | Hale | 297/129 |
| 5,350,215 | 9/1994 | DeMars | 297/129 X |
| 5,409,291 | 4/1995 | Lamb et al. | 297/129 |
| 5,573,288 | 11/1996 | Raffensperger | 297/188.3 X |
| 5,595,429 | 1/1997 | Kennedy | 297/188.13 X |
| 5,641,197 | 6/1997 | Springmann | 297/188.12 X |
| 5,660,296 | 8/1997 | Greenwich | 297/188.08 X |
| 5,692,335 | 12/1997 | Magnuson | 297/188.08 X |
| 5,722,717 | 3/1998 | Rettenberger | 297/188.13 X |

*Primary Examiner*—Peter M. Cuomo
*Assistant Examiner*—Rodney B. White
*Attorney, Agent, or Firm*—Price Gess & Ubell

[57] ABSTRACT

A portable seat including a receptacle attached below the textile material that comprises a seat plane. The receptacle is a larger storage space than previously offered due to a set of the protrusions located on the leg assemblies that enable the foldable backrest to achieve an operative position for sitting without encroaching upon receptacle space. The zippers extending to three sides of the receptacle also provides greater access to the inside of the receptacle.

9 Claims, 4 Drawing Sheets

43
10
39
37
19
21
21
31
11
15
17
13

43
39
37
23
19
24
21
21
27
42
26
33
35
11
31
10
15
13

FOLDING CHAIR WITH COOLER

BACKGROUND OF THE INVENTION

1. Field of the Invention

This invention relates in general to portable chairs. More specifically, the present invention relates to a collapsible chair which includes a storage compartment or pouch attached to the underside of the seat.

2. Description of Related Art

The prior art has combined portable chairs and storage compartments, such as, U.S. Pat. No. 3,122,397, which describes a fishing and convenience stool of the type that is provided with a support that includes a pair of U-shaped frames that are pivotally connected together, whereby the frames may be collapsed with respect to each other to facilitate carrying or storing. The seat embodies a removable receptacle for supporting fishing or various accessories. Although the stool is foldable and has a removable receptacle with minimal space, the stool, absent a backrest may be uncomfortable. Moreover, the removable receptacle, constructed of textile material and lacking insulation, does not function as a cooler.

U.S. Pat. No. 4,650,245, discusses a folding chair that includes a hollow box like housing forming a seat support structure and an insulated compartment. The insulated compartment, having a front access opening, provides access for a person seated on the seat support. A backrest is pivotally secured to the housing for extending upward in a support position and foldable onto the seat platform for a collapsed position. A pair of U-shaped leg members pivotally secured to the housing for supporting the housing in an elevated position with the leg members connected by linkage means to the backrest and foldable therewith to the collapsed position. The front access opening for the insulated compartment, designed to provide access by a person seated on the seat, is unlikely to provide access comfortably.

U.S. Pat. No. 5,722,717, discloses a golfer's portable chair equipped with a cleat tool attached to a frame that includes a storage compartment located beneath a seat cover. The seat cover can be removed via a releasable fastener to expose an access opening into the storage compartment. A separate cooler formed of an insulating material can be inserted into the storage compartment. A golfer must remove the seat cover before he can access the storage compartment. The backrest frame requires contact between a cross member and the leg members into order to keep the frame from pivoting back further, thereby inhibiting storage compartment/cooler space.

Whatever the precise merits, features and advantages of the above cited references, none of them achieves or fulfills the purpose of the present invention in providing a foldable chair with unobstructed access to a cooler having ample room, all within a slim and efficient design that folds into a compact transportable form.

SUMMARY OF THE INVENTION

The present invention provides a folding chair with unobstructed access to an attached cooler.

The present invention further provides a portable chair and cooler wherein the cooler has ample room.

The present invention additionally provides a slimmer, more compact design for a folding chair with an attached cooler.

A feature of the present invention resides in the structure of the folding chair with cooler. The chair is basically constructed from two U-shaped closed tubes that form the leg members and a support for a seat. A U-shaped chair back with a nylon panel may be pivotally mounted at the open end of one of the U-shaped leg members. Protruding portions on the U-shaped leg members hold the chair back in an upright operative position. The cooler top is preferably permanently fastened directly to the underside of the seat fabric along a longitudinal axis in order to provide a permanent hinge. The permanent hinge, coupled with a zippered opening that extends along the other three sides of the cooler, provides unobstructed access to the inside.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFFERED EMBODIMENTS

The following description is provided to enable any person skilled in the art to make and use the invention and sets forth the best modes, contemplated by the inventor, for carrying out his invention. Various modifications, however, will remain readily apparent to those skilled in the art, since the generic principles of the present invention have been defined herein specifically to provide a readily manufacturable and easily used foldable chair with cooler.

Figure 1:
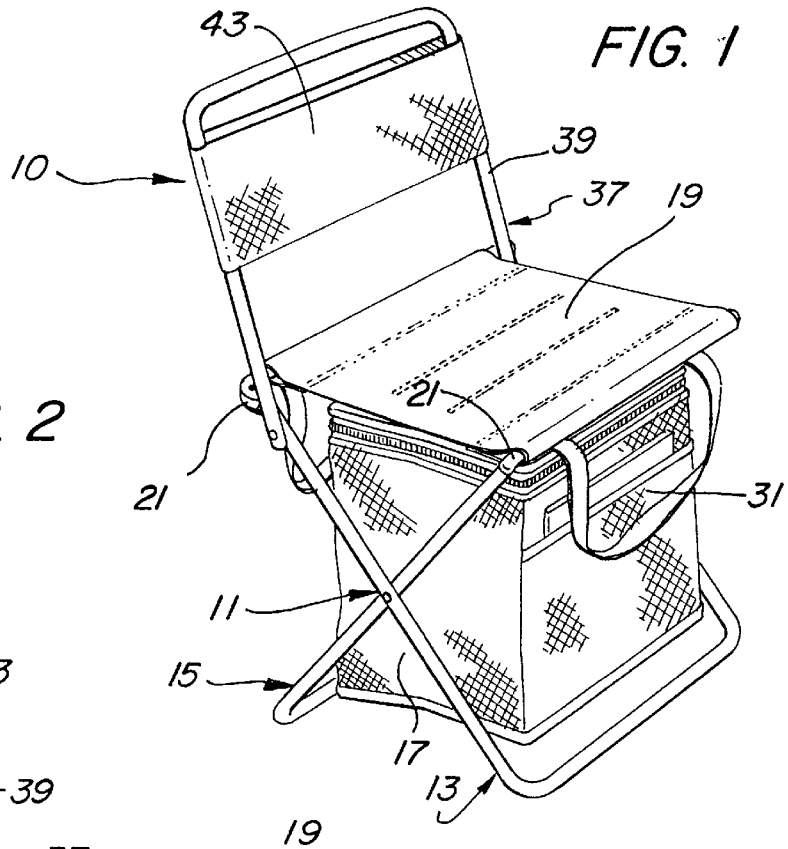
FIG. 1 is a front perspective view of a portable seat in accordance with a preferred embodiment of the present invention.

FIG. 1 illustrates a portable chair 10 with a pouch or storage receptacle 17 configured in accordance with a preferred embodiment of the present invention.

The portable chair 10 comfortably supports a person in a seated position at a conventional height (e.g., at a height about 10 to 25 inches). The portable seat 10 has a seat of sufficient width (e.g., about 10–20 inches) and a sufficient depth (e.g., about 10–20 inches) for a comfortable feel.

Figure 6:
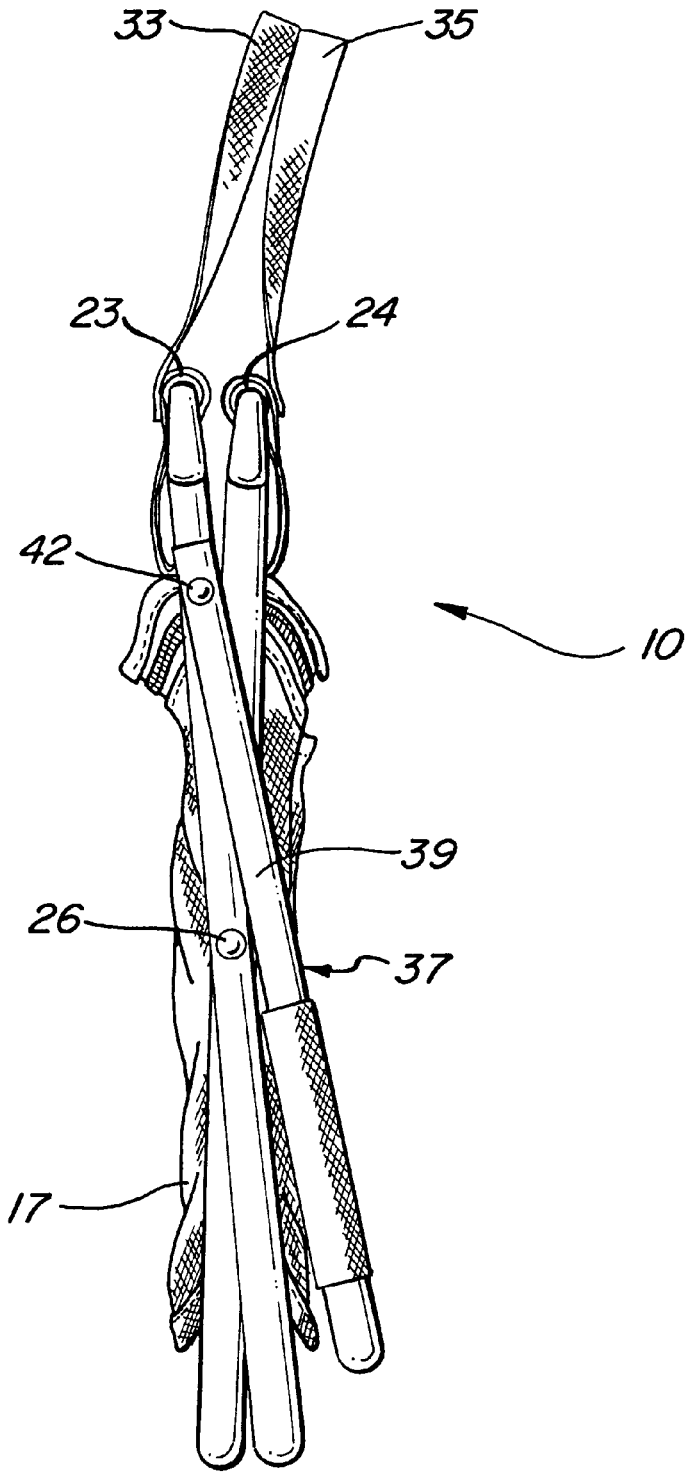
FIG. 6 is a side elevational view of the portable seat of FIG. 1 in a fully folded position.

The portable chair 10 advantageously has a durable, but lightweight construction which collapses to a compact state, as seen in FIG. 6, in order to be easily transported and stored. These features allow a person to readily use the portable chair 10 during a variety of activities, for example, when sitting on the beach, fishing, picnicking, attending sports activities or parades or hunting.

As seen in FIG. 1, the portable chair 10 principally includes a frame 11 which supports a seat fabric or seat member 19 that extends across a portion of the frame 11. The frame 11 also supports a receptacle or pouch 17 which lies between a pair of hollow tubular leg members 13, 15 of the frame 11 and below the seat fabric 19. The individual components of the portable chair 10 will now be described in detail.

In the illustrated embodiment, the frame 11 includes two hinged hollow tubular leg members or front and rear support members 13, 15 which allow the seat fabric 19 to fold flat. The front and rear leg members 13, 15 are substantially identical, and therefore, the description herein of one will be understood as applying equally to both, unless specified otherwise.

Figure 3:
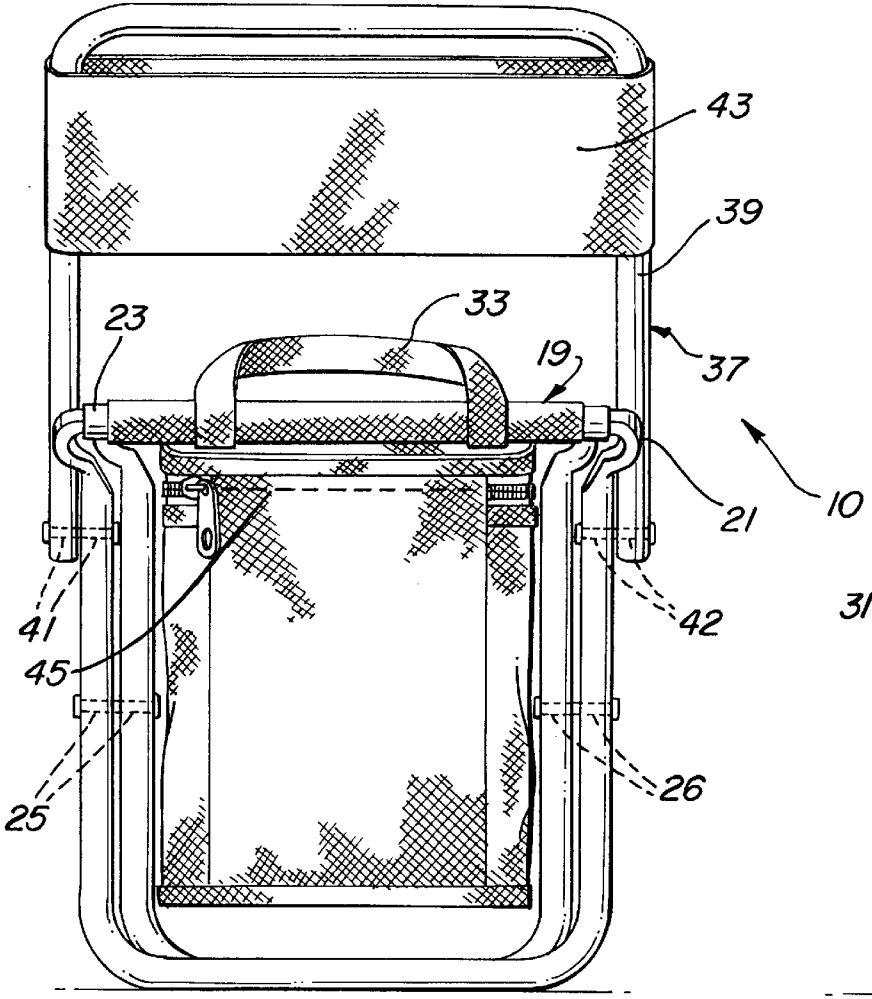
FIG. 3 is a front side elevational view of the portable seat of FIG. 1.

Each leg member 13, 15 generally has a U-shaped frame with curved protrusions 21 serving as ends at the open ends of the "U". As seen in FIG. 3, the leg members 13, 15 have their opened ends closed by rails 23, 24 which are connected thereto. The leg members 13, 15 and rails 23, 24 may be formed of an aluminum, steel, lightweight composite material or any lightweight material of sufficient strength.

The leg members 13, 15 are attached together by hinge couplings 25, 26 with the leg members 13, 15 at about a mid-point where the leg members 13, 15 overlap. The rear leg member 15 lies just inside a corresponding front leg member 13. A hinge pin 26 extends between the corresponding leg members 13, 15 at this crossing point at about the middle of the longitudinal length of each leg member 13, 15. In the illustrated embodiment, the hinge pin 26 is a bolt which passes through the holes formed in the corresponding leg members 13, 15. The bolt may be secured by clips, rivets, or in a similar manner allowing the leg members 13, 15 to smoothly pivot relative to each other.

Figure 5:
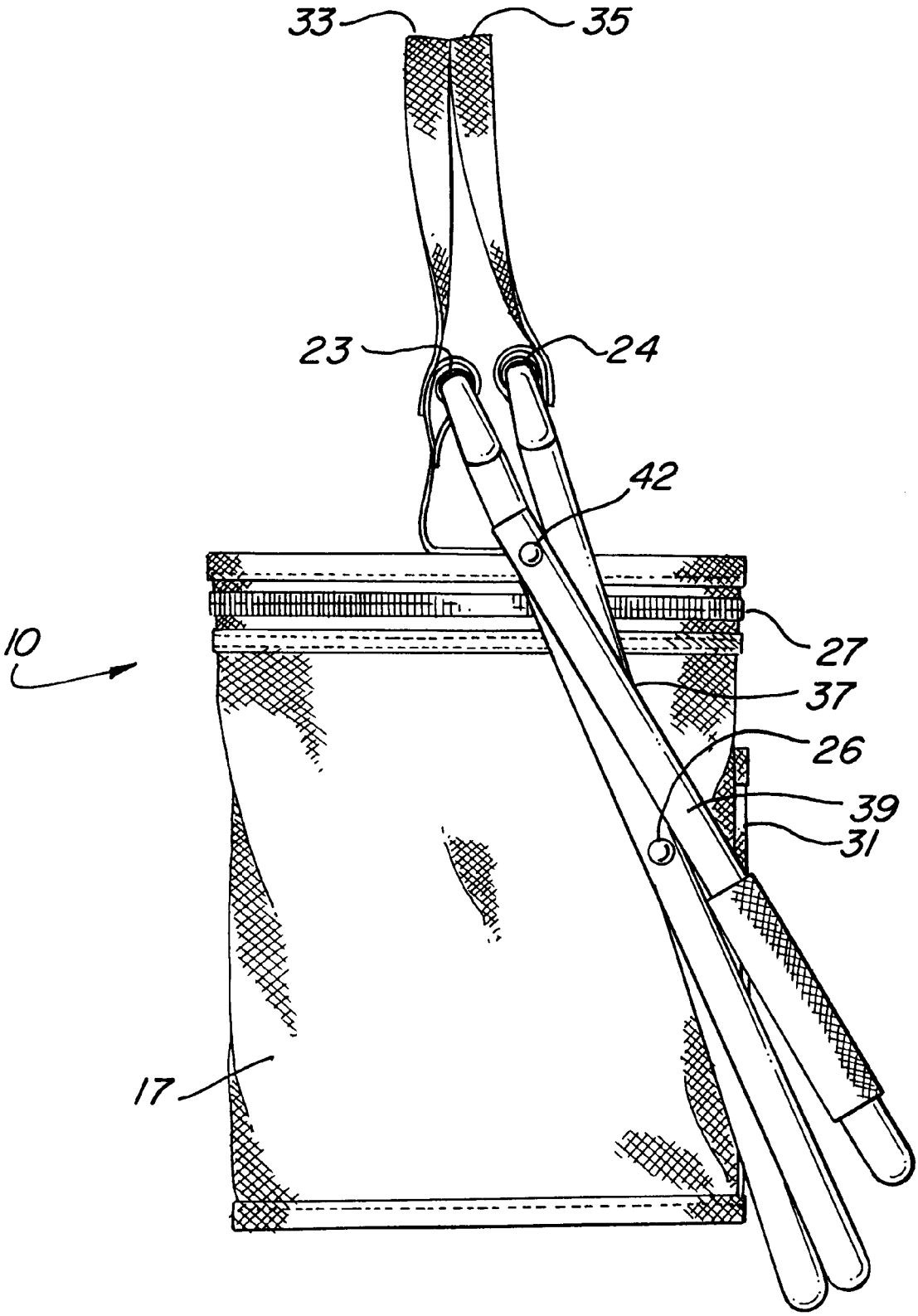
FIG. 5 is a side elevational view of the portable seat of FIG. 1 in a partially folded position.

The hinged construction allows the leg members 13, 15 to move from a partially or fully folded position (see FIGS. 5 and 6) to an open position (see FIG. 1). In the partially or fully folded position, as seen in FIGS. 5 and 6, the corresponding leg members 13, 15 lie generally adjacent to one another. As seen in FIG. 1, the rails 23, 24 are spaced apart from one another when the leg members 13, 15 are open. When opened, the corresponding leg members 13, 15 give the frame 11 an X-shape from the side with the rails 23, 24 lying at the desired height of the seat and connecting the open ends of the "U" on each leg 13, 15 together.

As seen in FIGS. 1–6, a pouch or receptacle 17 attaches below the seat fabric 19 and extends between the leg members 13, 15 of the frame 11. In the illustrated embodiment, the receptacle 17 generally has a rectangular shape constructed in a conventional manner. For instance, the storage receptacle 17 may be formed of a material, such as lightweight nylon that is folded upon itself and may optimally include a flexible closed cell foam or other insulating material.

FIG. 1 illustrates the receptacle 17 with a pocket 31 on the outerside for additional storage. Elastic bands, zippers, Velcro or snaps may releasably close the pocket 31.

Figure 2:
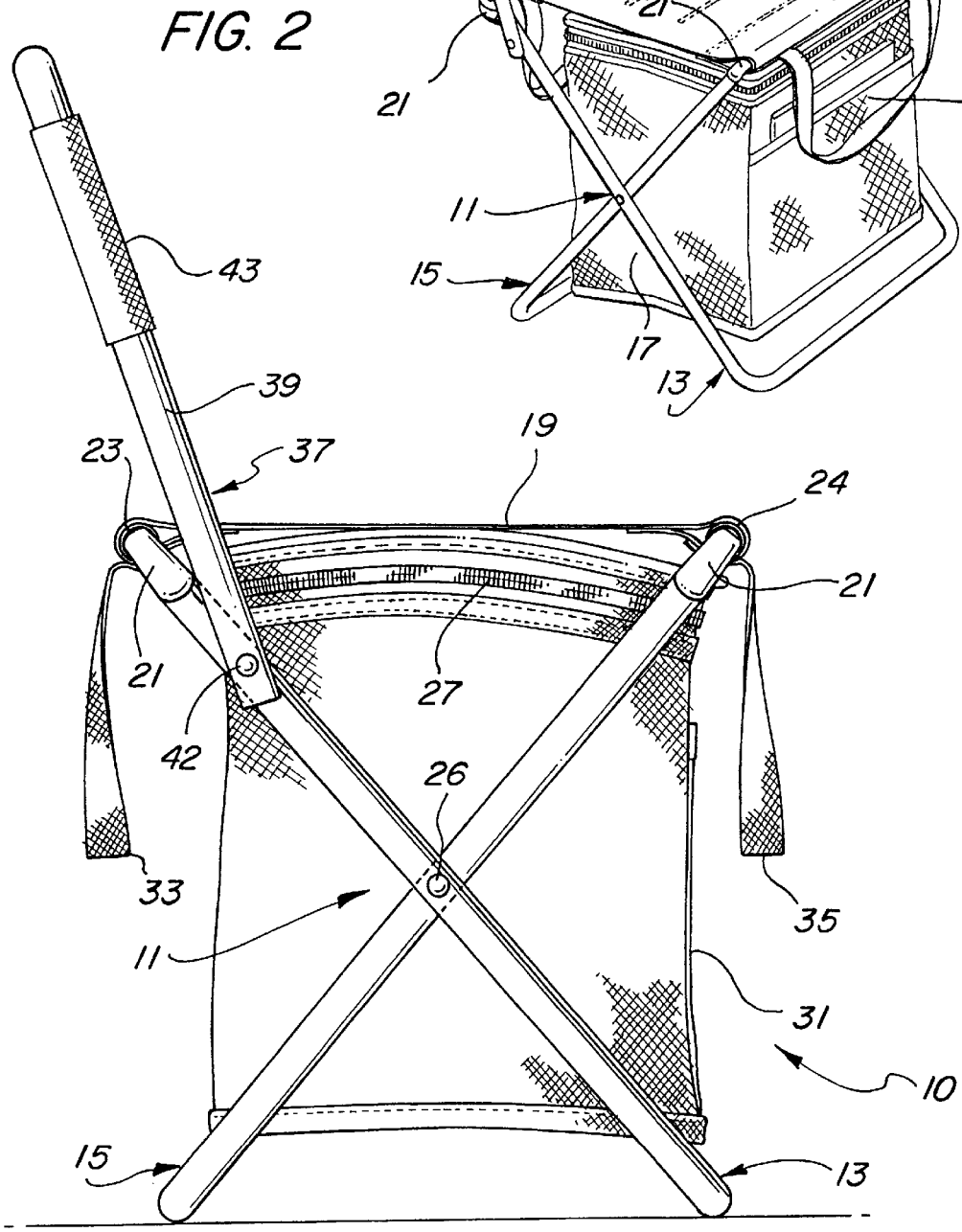
FIG. 2 is a left side elevational view of the portable seat of FIG. 1.

FIG. 2 illustrates loops 33, 35 that attach below the seat fabric 19 located underneath the rails 23, 24. The loops 33, 35 are constructed of a lightweight, weaved, flexible textile material, such as, a nylon or canvas cloth, for example. As seen in FIGS. 5 and 6, the loops 33, 35 are designed for carrying around the portable chair 10 when in a partially or fully folded position.

As seen in FIG. 2, the seat fabric 19 attaches to both rails 23, 24. The seat fabric 19 is formed of a strong durable material sewn to itself after wrapping around the rails 23, 24. It is contemplated, however, that the seat fabric 19 may attach to itself or the frame 11 by other means, such as, snaps, buttons, Velcro, or like fasteners.

With reference to FIG. 3, the portable chair 10 also includes a backrest frame 37, having a "U" shaped structure. In the illustrated embodiment, the U-shaped backrest frame 37 is formed by backrest support members 39 which attach to each front leg member 13 below the curved protruding portion 21 that connects to the rail 23. Hinge couplings 41, 42 connect the backrest frame 37 to the front leg member 13 of the frame 11. In the illustrated embodiment, a bolt extends between the front leg member 13 and the backrest frame 37. This hinge connection allows the backrest frame 37 to be generally folded flat, as seen in FIG. 6, with the seat frame in the closed position. As seen in FIG. 6, the backrest support members 39 of the backrest frame 37 lie generally adjacent to the leg members 13, 15 when in the closed position. In a raised position, as seen in FIG. 1, the backrest support members 39 extend vertically away from the seat fabric 19 and abutt the protruding portion 21 of the leg members 13. The contact between the backrest support members 39 and the protruding portion 21 of the legs 13 keeps the backrest frame 37 form pivoting back further.

In the illustrated embodiment, the backrest fabric 43 is a rectangular shaped loop that slips over the upper end of the support members 39 of the backrest frame 37. The backrest fabric 43 is held to the support members 39 by the tension between the backrest fabric 43 and the backrest frame 37. The backrest fabric 43, wider than the seat fabric 19, is constructed of the same material.

Figure 4:
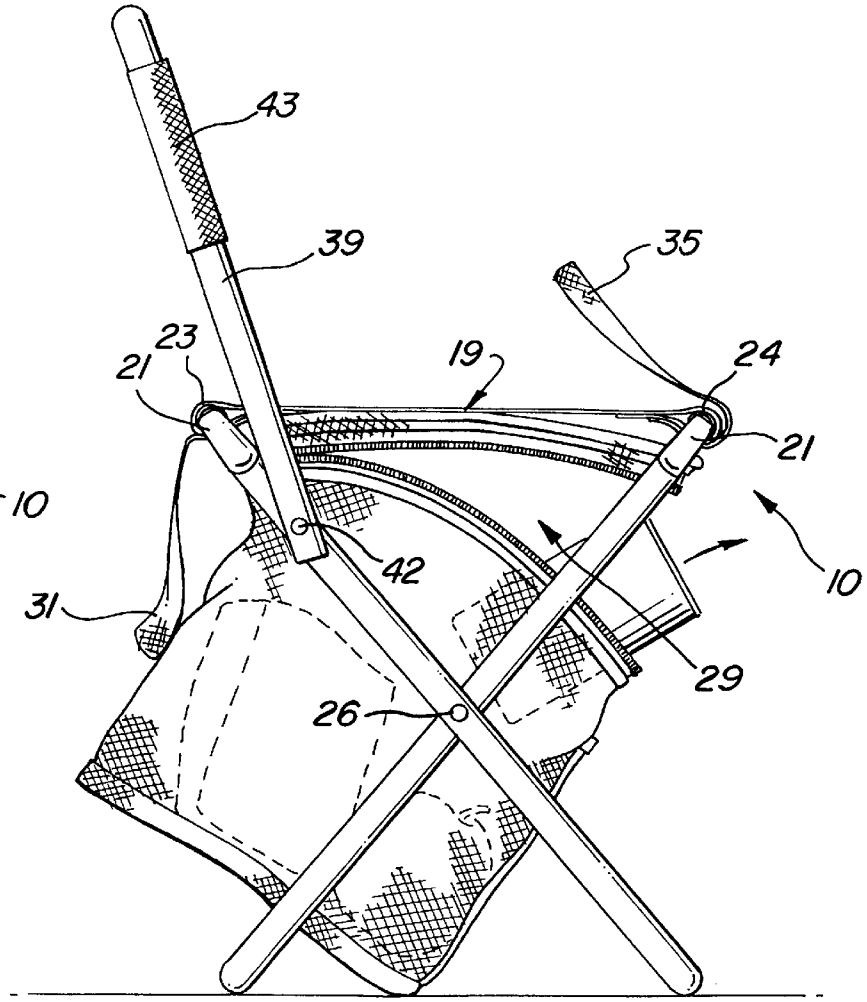
FIG. 4 is a left side elevational view of the portable seat of FIG. 1 drawn to expose a portion of the storage compartment of the portable seat.

Referring to FIG. 4, the portable chair 10 includes a receptacle 17 that is formed of an insulating material and functions as a cooler in order to house canned beverages, fruit, sandwiches and the like. The cooler receptacle or assembly 17 preferably has a rectangular shape with ample space. The top of the receptacle 17 is preferably permanently sewn to the underside of the seat fabric 19 or attached to it by other well known fastening means along a longitudinal axis in order to provide a permanent hinge 45. The permanent hinge 45 coupled with a zipper 27, snaps, buttons, Velcro, or like fasteners that extend to three sides of the receptacle 17 provide uninhibited access to the inside. In this manner, a person may conveniently access the receptacle 17 while remaining seated or kneeling beside the portable chair 10.

Having illustrated and described a preferred embodiment as well as variants of this invention, it will be obvious to those skilled in the art that further changes and modifications may become apparent. Such changes and modifications are not to affect this instant concept and are to be considered within the scope and essence of this invention.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

I claim:

1. A portable seat comprising:

a first leg assembly formed of tubular metal into a U-shaped frame with open ends with a protruding potion of the frame adjacent each open end;

a second leg assembly formed of tubular metal into a U-shaped frame with open ends with a protruding portion of the frame adjacent each open end;

a first rail attached to the protruding portions of the first leg assembly;

a second rail attached to the protruding portions of the second leg assembly;

the first leg assembly and second leg assembly being pivotally connected together at an intermediate point on each leg of the U-shaped frame;

a tubular U-shaped frame backrest pivotally mounted to one of said leg assemblies, beneath the protruding portions, and foldable to an upright position as a backrest when the seat is in use with the backrest frame contacting the protruding portions;

a flexible material fixedly attached to the rails of the first leg assembly and the second leg assembly and having a length sufficient to define a seat member when the first and second leg assemblies are spaced apart from each other; and a cooler assembly with an upper surface, a bottom surface and multiple sides forming an insulated housing with a central portion of the upper surface fixedly attached to a bottom surface of the seat member, the cooler assembly is suspended to hang from the bottom surface of the seat member between the first leg assembly and the second leg assembly when in an operative position as a seat so that the bottom surface of the cooler assembly is substantially parallel with the upper surface of the cooler assembly, the cooler assembly is hingedly connected along one side and removably connected on the other sides, whereby when the cooler assembly is released on the other sides, access is provided to a cavity for storage within the cooler assembly while it hangs along the hinged side from the bottom surface of the seat member.

2. The portable seat of claim 1, further comprising, a pair of loops attached to the seat member to permit carrying the portable seat when collapsed.

3. A portable seat comprising:

a first leg assembly formed of tubular metal into a U-shaped frame with open ends with a protruding portion of the frame adjacent each open end;

a second leg assembly formed of tubular metal into a U-shaped frame with open ends with a protruding portion of the frame adjacent each open end;

a first rail attached to the protruding portions of the first leg assembly;

a second rail attached to the protruding portions of the second leg assembly;

the first leg assembly and second leg assembly being pivotally connected together at an intermediate point on each leg of the U-shaped frame;

a flexible material fixedly attached to the rails of the first leg assembly and the second leg assembly and having a length sufficient to define a seat member when the first and second leg assemblies are spaced apart from each other; and a cooler assembly with an upper surface, a bottom surface and multiple sides forming an insulated housing with a central portion of the upper surface fixedly attached to a bottom surface of the seat member, the cooler assembly is suspended to hang from the bottom surface of the seat member between the first leg assembly and the second leg assembly when in an operative position as a seat so that the bottom surface of the cooler assembly is substantially parallel with the upper surface of the cooler assembly, the cooler assembly is hingedly connected along one side and removably connected on the other sides by a zipper member, whereby when the cooler assembly is released on the other sides by the zipper member, access is provided to a cavity for storage within the cooler assembly while it hangs along the hinged side from the bottom surface of the seat member.

4. The portable seat of claim 3, wherein said cooler assembly further includes an open pocket on one of the cooler assembly sides.

5. The portable seat of claim 3, further comprising a pair of loops attached to the seat member to permit carrying the portable seat when collapsed.

6. A combination foldable seat and cooler assembly, comprising:

a front support member;

a rear support member movably connected to the front support member to permit the front support member to be extended from the rear support member to an operative position and to be retracted adjacent the rear support member for transportation;

a flexible seat member fixedly attached to and extending between the front support member and the rear support member, the seat member can support a user when the front support member is extended from the rear support member to an operative position as a seat; and a cooler assembly with an upper surface, a bottom surface and multiple sides forming an insulated housing with a central portion of the upper surface fixedly attached to a bottom surface of the seat member, the cooler assembly is suspended to hang from the bottom surface of the seat member between the front support member and the rear support member when in an operative position as a seat so that the bottom surface of the cooler assembly is substantially parallel with the upper surface of the cooler assembly, the cooler assembly is hingedly connected along one side and removably connected on the other sides, access is provided to a cavity for storage within the cooler assembly, while it hangs along the hinged side from the bottom surface of the seat member.

7. The combination foldable seat and cooler assembly of claim 6 further including a zipper member extending along three sides of the cooler assembly about the hingedly connected side to permit a removable connection of those three sides from the upper surface of the cooler assembly.

8. The combination foldable seat and cooler assembly of claim 7 further including at least one strap attached to the seat member for carrying the combination foldable seat and cooler assembly.

9. The combination foldable seat and cooler assembly of claim 8 further including a pivotable backrest attached to the rear support member.

* * * * *